US009248680B2

(12) United States Patent
Flitsch et al.

(10) Patent No.: US 9,248,680 B2
(45) Date of Patent: Feb. 2, 2016

(54) METHOD AND DEVICE FOR USED RIBBON DESTRUCTION

(75) Inventors: Timothy J. Flitsch, Lakeville, MN (US); Richard C. Nubson, Eden Prairie, MN (US); James M. Jordan, Eagan, MN (US); Milo B. Squires, Chaska, MN (US); Jeanette E. Jordan, legal representative, Eagan, MN (US)

(73) Assignee: ENTRUST DATACARD CORPORATION, Shakopee, MN (US)

( * ) Notice: Subject to any disclaimer, the term of this patent is extended or adjusted under 35 U.S.C. 154(b) by 549 days.

(21) Appl. No.: 13/641,826

(22) PCT Filed: Apr. 26, 2011

(86) PCT No.: PCT/US2011/033970

§ 371 (c)(1),
(2), (4) Date: Oct. 17, 2012

(87) PCT Pub. No.: WO2011/139703

PCT Pub. Date: Nov. 10, 2011

(65) Prior Publication Data

US 2013/0032587 A1 Feb. 7, 2013

Related U.S. Application Data

(60) Provisional application No. 61/327,922, filed on Apr. 26, 2010.

(51) Int. Cl.
*B21B 27/06* (2006.01)
*B41J 35/38* (2006.01)

(52) U.S. Cl.
CPC ..... *B41J 35/38* (2013.01); *Y10T 83/0524* (2015.04); *Y10T 83/9372* (2015.04)

(58) Field of Classification Search
CPC .. B41J 35/38; H01L 27/1288; H01L 29/6675; H01L 29/78645
USPC ..... 347/1, 84, 95, 96, 100, 101, 102, 104, 347/105, 131, 171, 172, 173, 174, 179, 203, 347/205, 215, 223, 229, 233, 234, 248; 219/469; 83/39, 663
See application file for complete search history.

(56) References Cited

U.S. PATENT DOCUMENTS 5,018,419 A * 5/1991 Omura ..... 83/451
2011/0001787 A1* 1/2011 Xu et al. ..... 347/179

FOREIGN PATENT DOCUMENTS

CN 201186538 1/2009
DE 3702145 9/1987

(Continued)

OTHER PUBLICATIONS

International Search Report for international application No. PCT/US2011/033970, dated Jan. 9, 2012 (3 pages).

(Continued)

*Primary Examiner* — Dana Ross
*Assistant Examiner* — Joseph Iskra
(74) *Attorney, Agent, or Firm* — Hamre, Schumann, Mueller & Larson, P.C.

(57) ABSTRACT

Methods and devices are described for securely destroying used ribbon from a document personalization machine in order to render any information retained on the used ribbon as unreadable. In one embodiment, the method includes tapering the used ribbon into a used ribbon strand by feeding the used ribbon through a tapering mechanism. The method also includes heating the used ribbon strand to fuse the used ribbon strand into a used ribbon string thereby rendering any data retained on the used ribbon unreadable.

20 Claims, 5 Drawing Sheets

(56) References Cited

FOREIGN PATENT DOCUMENTS

| | | | |
|---|---|---|---|
| JP | H0381184 | | 4/1991 |
| JP | 03-183586 | | 8/1991 |
| JP | H03183586 | * | 8/1991 |
| JP | 10-086424 | | 4/1998 |
| JP | 2003-341118 | * | 12/2003 |

OTHER PUBLICATIONS

Written Opinion for international application No. PCT/US2011/033970, dated Jan. 9, 2012 (4 pages).

* cited by examiner

METHOD AND DEVICE FOR USED RIBBON DESTRUCTION

FIELD

A used ribbon destruction method and device for securely destroying used ribbon, for example ribbons used in card or passport personalization equipment.

BACKGROUND

When a print ribbon or other ribbon material is used to print/produce personal information on a plastic card, passport or other personalized document, certain personal information, such as names and account numbers, are left behind on the used ribbon. For example, in the case of a print ribbon, portions of the used ribbon where ink was transferred from the ribbon to the card or document retain the information transferred onto the card or document. This can create potential liability issues for the party printing cards or documents using a printer machine, as the used ribbon may contain secure and private information. Accordingly, it is common to destroy the used ribbon in order to prevent an unauthorized party from accessing the secure and private information.

SUMMARY

The following technical disclosure describes methods and devices for securely destroying used ribbon-like material in card, passport or other types of personalization equipment. One common use would be destroying print ribbons used in desktop or modular personalization machines that personalize cards, passports, or other personalized documents. However, the concepts described herein could be used to destroy any type of ribbon-like material that may, after use, contain residual personal information. Examples of such ribbon-like material include, for example: indent ribbon and indent printing foils; retransfer ribbon and retransfer material (RTM); topping foils; monochromatic (graphics) ribbon; CMYK (Cyan Magenta Yellow blacK) plus spot color thermal (re) transfer ribbon; and primer ribbon. While the list above includes some of the more common ribbon-like material that can be destroyed using the concepts described herein, it would be obvious to those skilled in the art that other types of ribbon-like material can be destroyed using the concepts described herein.

The methods and devices described herein are directed to transforming used ribbon into a used ribbon string that renders any information retained on the used ribbon, for example names, account numbers, etc., as unreadable, thereby effectively destroying the used ribbon.

While the embodiments described herein are described as being employed within a modular central issuance personalization machine, the methods and devices described herein can also be employed in other types of document personalization machines including, for example, a desktop printer personalization machine. Moreover, the concepts can be used on other types of personalization equipment that perform personalization other than or in addition to printing.

In one embodiment, a method for securely destroying used ribbon from a document personalization machine is provided. The method includes tapering the used ribbon into a used ribbon strand by feeding the used ribbon through a tapering mechanism. The method also includes heating the used ribbon strand to fuse the used ribbon strand into a used ribbon string, thereby rendering any data retained on the used ribbon unreadable. In one embodiment, the used ribbon string can then be wound around a take-up spool that can be removed from the document personalization machine for disposal. In another embodiment, the used ribbon string can be chopped and placed into a removable bin that can be removed from the document personalization machine to dispose of the chopped used ribbon string.

In another embodiment, a device for securely destroying used ribbon from a document personalization machine is provided. The device includes a tapering mechanism and a heating mechanism. The tapering mechanism is positioned to receive the used ribbon and tapers the used ribbon into a used ribbon strand. The heating mechanism heats the used ribbon strand which fuses the used ribbon strand into a used ribbon string, thereby rendering any data retained on the used ribbon unreadable. In one embodiment, the device also includes a disposing mechanism that includes a take-up spool that winds the used ribbon string. The take-up spool can be removed from the document personalization machine for disposal. In another embodiment, the disposing mechanism includes cutting rollers that cut the used ribbon string into a plurality of pieces, and a removable bin that can be removed from the document personalization machine for disposing the pieces of the used ribbon string.

DETAILED DESCRIPTION

Typically, when information is printed on a card, passport or other personalized document, the portions of the ribbon where ink was used for printing the information onto the card or document retains the information printed on the card or document. The embodiments described herein generally provide methods and devices for securely destroying used ribbon so as to prevent any information on the used ribbon from being accessed by an unauthorized party. In particular, the embodiments discussed herein are directed to methods and devices for securely transforming used ribbon into a used ribbon string that renders any information retained on the used ribbon as unreadable.

The concepts described herein could be used to destroy any type of ribbon-like material that may, after use, contain residual personal information. Examples of such ribbon-like material include, for example: indent ribbon and indent printing foils; retransfer ribbon and retransfer material (RTM); topping foils; monochromatic (graphics) ribbon; CMYK (Cyan Magenta Yellow blacK) plus spot color thermal (re) transfer ribbon; and primer ribbon. While the list above includes some of the more common ribbon-like material that can be destroyed using the concepts described herein, it would be obvious to those skilled in the art that other types of ribbon-like material can be destroyed using the concepts described herein. In this specification the terms "ribbon", "print ribbon" and "ribbon-like material" are used interchangeably and are intended to refer to the examples of ribbon-like material described above as well as any other types of ribbon-like material that can be destroyed using the concepts described herein.

For sake of convenience, the embodiments described herein are described as being employed within a modular central issuance personalization machine. However, the methods and devices described herein can also be employed in other types of personalization machines including, for example, a desktop personalization machine. Moreover, the concepts described herein can be used on other types of personalization equipment that perform personalization other than or in addition to printing.

Figure 1:
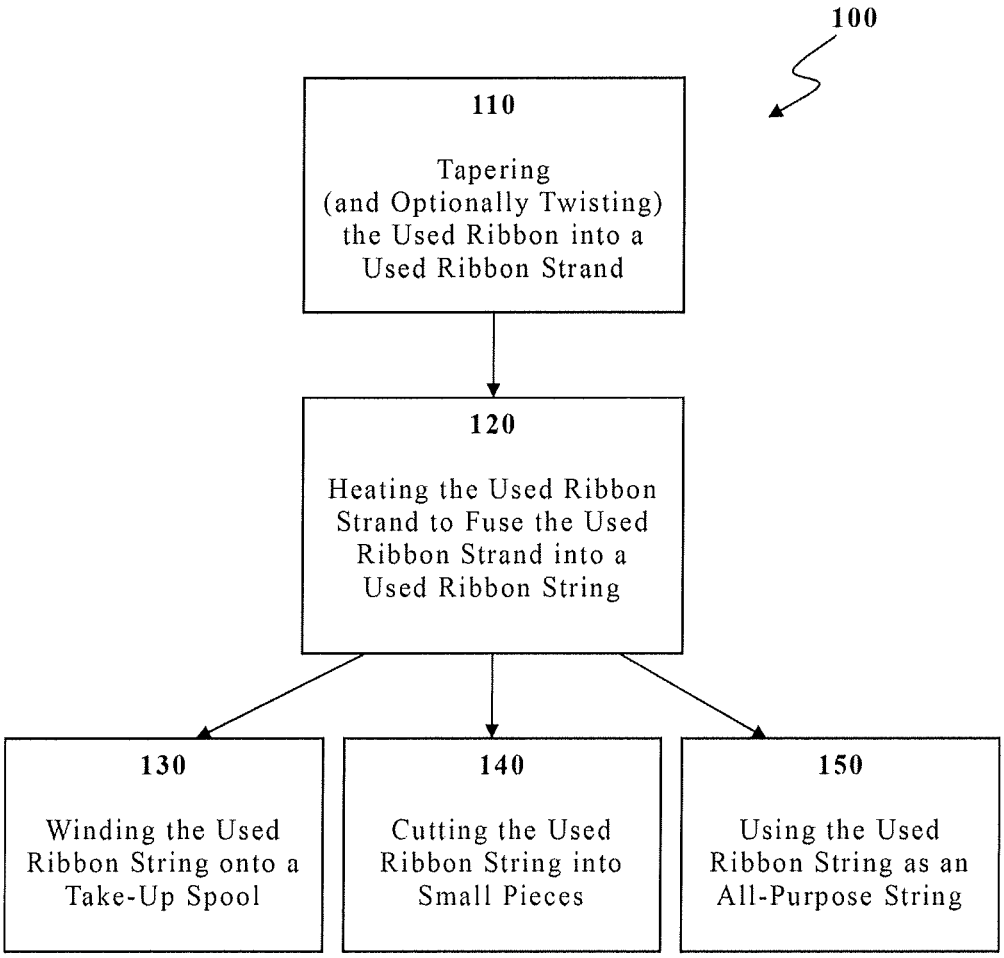
FIG. 1 illustrates a flow chart of how a used ribbon is securely destroyed, according to one embodiment.

FIG. 1 illustrates a flow chart 100 of how to securely destroy used ribbon, according to one embodiment. The flow chart 100 begins at step 110 where used ribbon, after passing through the print head, is tapered into a used ribbon strand by feeding the used ribbon through a tapering mechanism that includes an aperture and a pincher. The size of the aperture, the strength of the pincher, and the width and thickness of the used ribbon all factor into the resulting width and thickness of the resulting used ribbon strand. Thus, different sized apertures and different strength pinchers can be used based on the size of the used ribbon or to fit the needs of the user.

In some embodiments, the used ribbon is also twisted while passing through the aperture to ensure that the resulting used ribbon strand does not increase substantially in width or thickness after passing through the tapering mechanism. After step 110, the flow chart 100 then proceeds to step 120.

At step 120, the used ribbon strand is heated to fuse the used ribbon strand into a used ribbon string. The temperature at which the used ribbon strand is heated should be sufficient to fuse the used ribbon strand into a used ribbon string. For example, in the embodiment described herein, the ribbon strand is heated at approximately 150 to 200 degrees Celsius.

However, in other embodiments, the temperature at which the ribbon strand is heated may change depending on factors including the type of ribbon that is being destroyed and the type of printing machine the concepts described herein are being employed in. For example, in large and/or fast printer machines, such as a modular central issuance personalization machine, the temperatures at which the ribbon strand is heated will likely be higher because of the higher speed in which ribbon is being used for printing and the shorter time duration allowed for destruction of the ribbon. In contrast, in small and/or slower printer machines, such as a desktop personalization machine, the temperatures at which the ribbon strand is heated may be at a lower temperature in order to reduce costs in manufacturing the printer machine and because the speed in which the ribbon is being used for printing may be slower.

Also, in some embodiments, for example in some modular central issuance personalization machines, the temperature at which the ribbon is heated can be configured by the user. In other embodiments, for example in some desktop personalization machines, the temperature at which the ribbon is heated is fixed and cannot be adjusted by the user.

By fusing the used ribbon strand to form the ribbon string, the ribbon cannot be unfolded to allow viewing of any residual information on the ribbon. Therefore, any information that may have been retained on the used ribbon is rendered unreadable, effectively destroying the used ribbon.

Once the ribbon is fused into the used ribbon string, the flow chart 100 then proceeds to either step 130, step 140 or step 150 where the used ribbon string is disposed of based on the requirements of the user.

At step 130, the used ribbon string is wound around a take-up spool. After a sufficient amount of used ribbon string is wound around the take-up spool, the user can then dispose of the take-up spool, and thereby dispose of the used ribbon string.

Alternatively, as shown at step 140, instead of winding the ribbon string onto a spool, the used ribbon string can be disposed of by cutting the used ribbon string into pieces, with the pieces then being disposed of.

Alternatively, as shown at step 150, the used ribbon string can be disposed of by using the used ribbon string as an all-purpose string for a variety of other applications as required by the user. Applicant has found that the used ribbon string, once fused, has surprising tensile strength, which permits the string to be used in a manner similar to conventional string.

Figure 2:
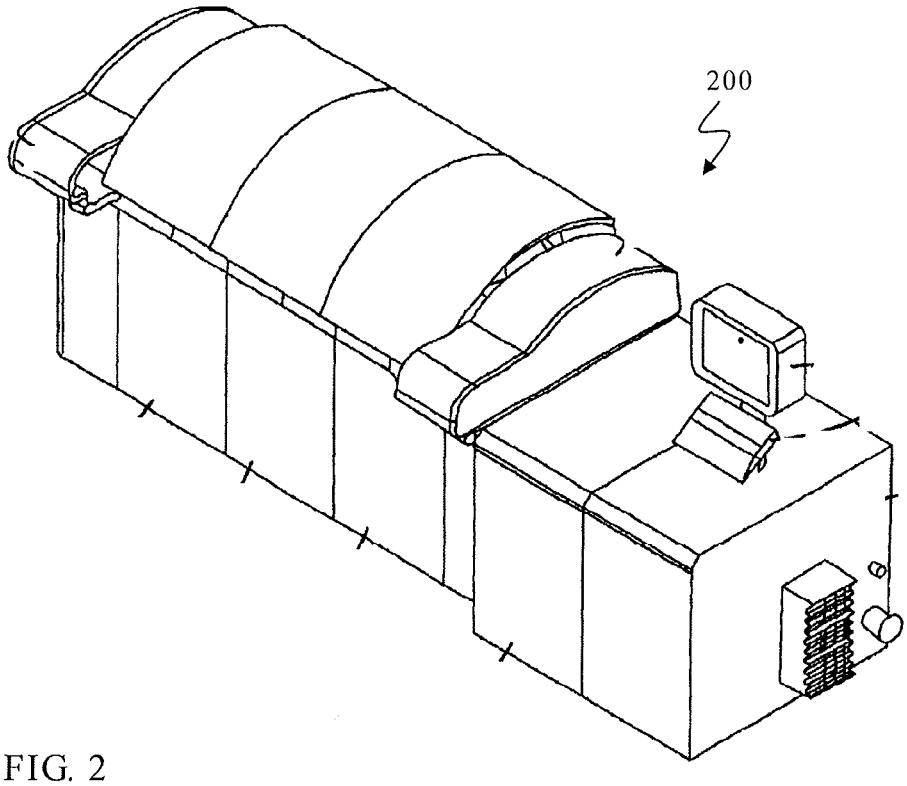
FIG. 2 illustrates a perspective view of a modular central issuance personalization machine that can incorporate the used ribbon destruction device according to one embodiment.

FIG. 2 is a perspective view of one embodiment of a modular central issuance personalization machine 200 that can incorporate a device for securely destroying used ribbon. However, in other embodiments, other types of document personalization devices, such as a desktop personalization machine, can be used.

Figure 3:
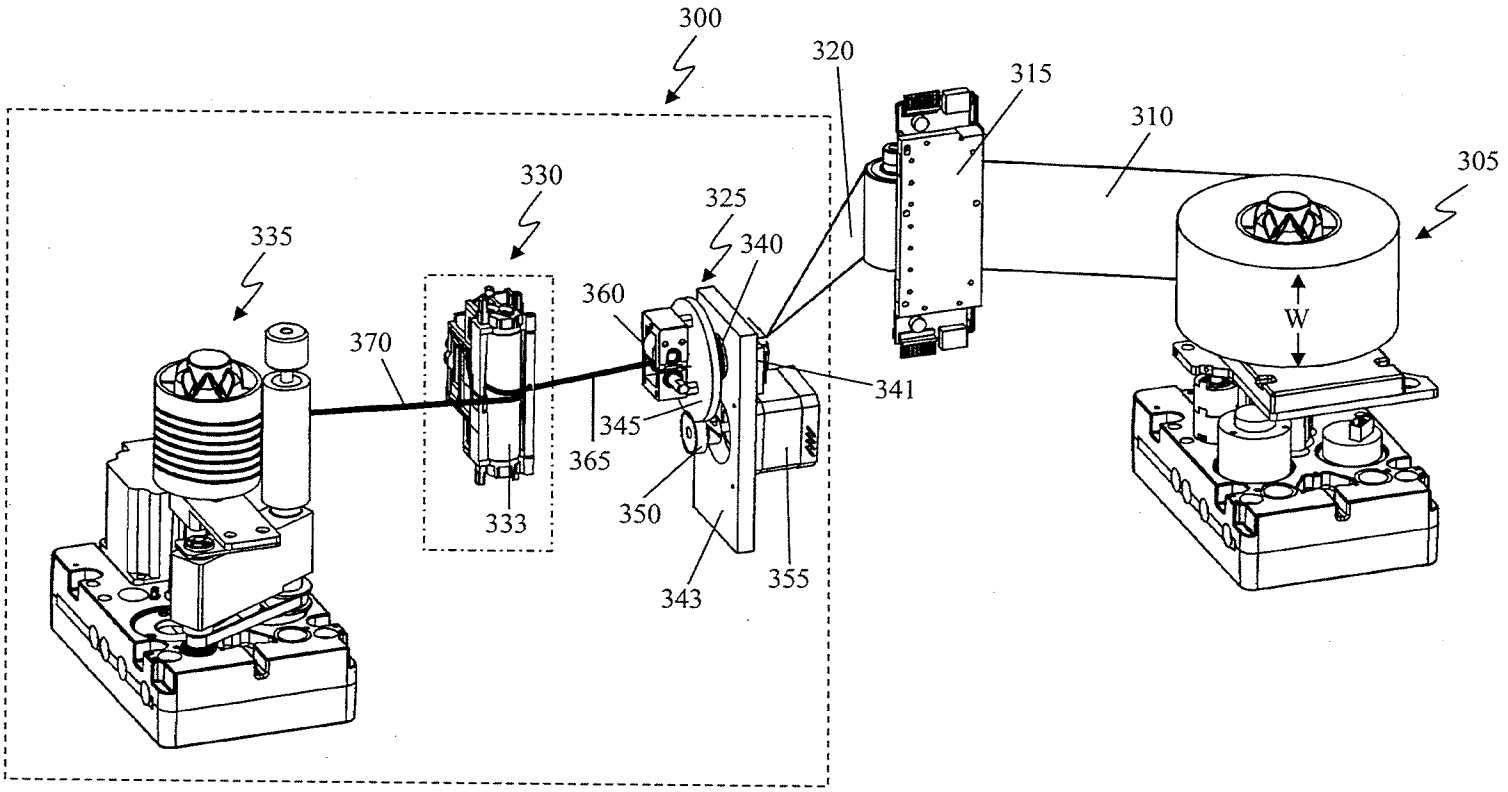
FIG. 3 illustrates a perspective view of a first embodiment of a used ribbon destruction device incorporated within the modular central issuance personalization machine of FIG. 2.

FIG. 3 schematically depicts one embodiment of a used ribbon destruction device 300 mounted within the modular central issuance personalization machine 200 of FIG. 2. A print ribbon supply spool 305 supplies print ribbon 310 to a print mechanism 315, for example a thermal print head. After printing or otherwise passing by the print mechanism 315, the print ribbon is considered to be used ribbon 320. The used ribbon 320 is then directed to the used ribbon destruction device 300 for destroying the ribbon.

In the illustrated example, the used ribbon destruction device 300 includes a tapering mechanism 325, a heating mechanism 330, and disposing mechanism 335.

The tapering mechanism 325 includes an aperture 340, a rotating disk 345, and a pincher 360. The tapering mechanism 325 is configured to taper the used ribbon 320 into a used ribbon strand 365.

The aperture 340 is an opening formed through an entry plate 341, a support plate 343 and the rotating disk 345. The aperture 340 can be any type of opening that works in conjunction with the pincher 360 to taper the used ribbon 320 into the used ribbon strand 365. For example, the aperture 340 can be a hole, a slot, or other type of passageway or geometry through which the used ribbon 320 passes to cause the used ribbon 320 to become tapered. The aperture 340 can be tapered so that its dimension at the entry plate 341 is greater than its dimension at the rotating disk 345.

In the embodiment shown in FIG. 3, the used ribbon 320 is also twisted by the rotating disk 345 while passing through the aperture 340. This twisting is performed to ensure that the resulting used ribbon strand 365 does not increase substantially in width or thickness after passing through the pincher 360. In the embodiment shown in FIG. 3, the twisting is caused by rotating the rotating disk 345 while the used ribbon 320 is fed through the aperture 340. The rotating disk 345 is driven by a driver (i.e. spinner) disk 350 attached to a motor 355.

After the used ribbon 320 is tapered and twisted by passing through the aperture 340 of the rotating disk 345, the tapered and twisted used ribbon 320 is passed through the pincher 360 that pinches the tapered and twisted used ribbon 320 into the used ribbon strand 365.

The size of the aperture 340 where the used ribbon strand 365 exits the aperture 340, the strength of the pincher 360, and the width and thickness of the used ribbon 320 all factor into the resulting width and thickness of the resulting used ribbon strand 365. The size of the aperture 340 where the used ribbon strand 365 exits the aperture 340 is sufficiently small to taper the used ribbon 320 passing through the aperture 340. In the embodiment described herein, the size of the aperture 340 where the used ribbon strand 365 exits the aperture 340 is between 0.1 to 0.15 inches in diameter. For example, in the embodiment shown in FIG. 3, the aperture 340 where the used ribbon strand 365 exits the aperture 340 is sized and the pincher 360 is configured to taper the used ribbon 220 having a width W of about 5.7 cm (about 2.25 in) and a thickness of about 0.00254 cm (about 0.001 in) into the used ribbon strand 365 having a width of about 0.1905 cm (about 0.075 in) and a thickness of about 0.0254 cm (about 0.010 in). In other embodiments, the size of the aperture 340 where the used ribbon strand 365 exits the aperture 340 can be adjusted for different sized used ribbons or to fit the needs of the user.

After the used ribbon 320 is tapered, twisted and pinched by the tapering mechanism 325 to form the used ribbon strand 365, the used ribbon strand 365 is then fed to the heating mechanism 330. In the embodiment of FIG. 3, the heating mechanism 330 is a heated roller 333.

In some embodiments, the heated roller 333 is a hard roller, in which at least the outer layer of the heated roller 333 is made of a steel material. In other embodiments, the heated roller 333 is a compliant roller, in which at least the outer layer of the heated roller 333 is made of a rubber back material.

Also, in the embodiment shown in FIG. 3, the heated roller 333 is a heated to heat the material of the used ribbon strand 365 sufficiently to cause the used ribbon strand 365 to fuse into a used ribbon string 370. The temperature of the heated roller 333 should be sufficient to fuse the used ribbon strand 365 into a used ribbon string 370 and can vary depending on the type of ribbon used. For example, in the embodiment described herein, the heated roller 333 is heated to a temperature such that the used ribbon strand 365 is heated to a temperature between 150 to 200 degrees Celsius. However, based on the needs of the user, the temperature of the heated roller 333 is configurable and can be adjusted by the user.

As shown in FIG. 3, the used ribbon strand 365 makes at least one complete revolution around the heated roller 333. However, in some embodiments, the heated roller 333 is replaced with a can be driven by a backup roller (not shown) in order to help pull the used ribbon 320 past the print mechanism 315, through the tapering mechanism 325 and into the heating mechanism 330 to feed the used ribbon strand 365 around the roller 333.

By fusing the used ribbon strand 365 to form the used ribbon string 370, the ribbon cannot be unrolled, thereby preventing access to any information that may have been imparted onto the used ribbon 320, effectively destroying the used ribbon 320.

As shown in FIG. 3, after winding the used ribbon strand 365 around the heated roller 333 of the heating mechanism 330, the resulting used ribbon string 370 is then fed to the disposing mechanism 335.

The disposing mechanism 335 includes a disposable take-up spool 380 that winds the used ribbon string 370. The disposable take-up spool 380 is rotatably driven by a motor in order to pull the ribbon from the supply spool 305, past the print mechanism 315, through the tapering mechanism 325, through the heating mechanism 330, and onto the disposable take-up spool 380. Once a sufficient amount, as determined by the user, of the used ribbon string 370 is wound around the disposable take-up spool 380, the disposable take-up spool 380 can be simply removed and disposed of and replaced with a new disposable take-up spool in the disposing mechanism 335.

In some embodiments, the take-up spool 380 is replaced with cutting rollers to cut the used ribbon string 370 into a plurality of pieces, and a removable bin that allows the user to remove and dispose of the cut pieces of the used ribbon string 370.

Figure 4:
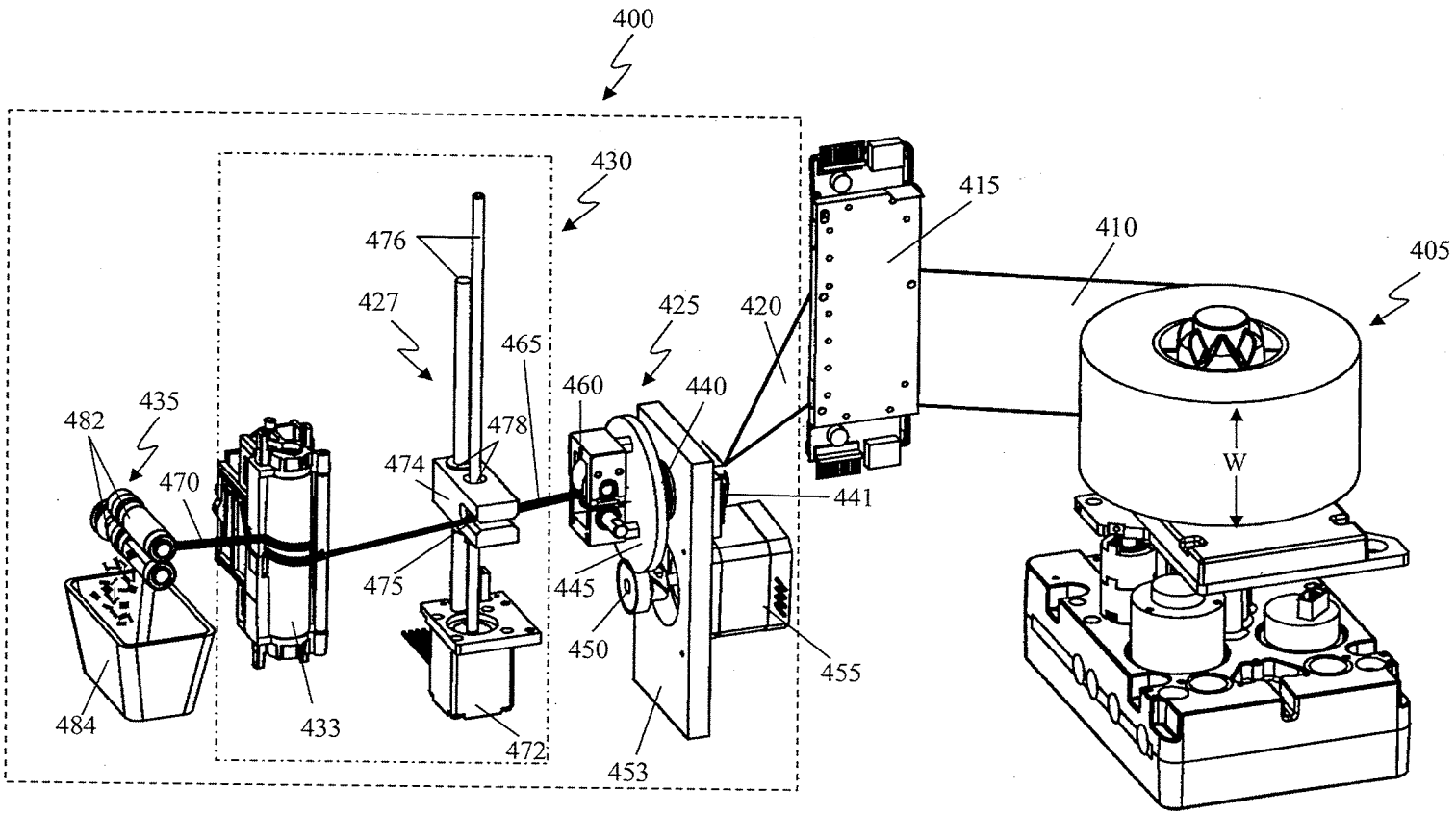
FIG. 4 illustrates a perspective view of second embodiment of a used ribbon destruction device incorporated within the modular central issuance personalization machine of FIG. 2.

FIG. 4 schematically depicts a second embodiment of a used ribbon destruction device 400 mounted within the modular central issuance personalization machine 200 of FIG. 2. A print ribbon supply spool 405 supplies print ribbon 410 to a print mechanism 415, for example a thermal print head. After printing or otherwise passing by the print mechanism 415, the print ribbon is considered to be used ribbon 420. The used ribbon 420 is then directed to the used ribbon destruction device 400 for destroying the ribbon.

In the illustrated example, the used ribbon destruction device 400 includes a tapering mechanism 425, a heating mechanism 430 and a disposing mechanism 435.

The tapering mechanism 425 includes an aperture 440, a rotating disk 445, and a pincher 460. The tapering mechanism 425 is configured to taper the used ribbon 420 into a used ribbon strand 465.

The aperture 440 is an opening formed through an entry plate 441, a support plate 443 and the rotating disk 445. The aperture 440 can be any type of opening that works in conjunction with the pincher 460 to taper the used ribbon 420 into the used ribbon strand 465. For example, the aperture 440 can be a hole, a slot, or other type of passageway or geometry through which the used ribbon 420 passes to cause the used ribbon 420 to become tapered. The aperture 440 can be tapered so that its dimension at the entry plate 441 is greater than its dimension at the rotating disk 445.

In the embodiment shown in FIG. 4, the used ribbon 420 is also twisted by the rotating disk 445 while passing through the aperture 440. This twisting is performed to ensure that the resulting used ribbon strand 465 does not increase substantially in width or thickness after passing through the pincher 460. In the embodiment shown in FIG. 4, the twisting is caused by rotating the rotating disk 445 while the used ribbon 420 is fed through the aperture 440. The rotating disk 445 is driven by a driver (i.e. spinner) disk 450 attached to a motor 455.

After the used ribbon 420 is tapered and twisted by passing through the aperture 440 of the rotating disk 445, the tapered and twisted used ribbon 420 is passed through the pincher 460 that pinches the tapered and twisted used ribbon 420 into the used ribbon strand 465.

The size of the aperture 440 where the used ribbon strand 465 exits the aperture 440, the strength of the pincher 460, and the width and thickness of the used ribbon 420 all factor into the resulting width and thickness of the resulting used ribbon strand 465. The size of the aperture 440 where the used ribbon strand 465 exits the aperture 440 is sufficiently small to taper the used ribbon 420 passing through the aperture 440. In the embodiment described herein, the size of the aperture 440 where the used ribbon strand 465 exits the aperture 440 is between 0.1 to 0.15 inches in diameter. For example, in the embodiment shown in FIG. 4, the aperture 440 where the used ribbon strand 465 exits the aperture 440 is sized and the pincher 460 is configured to taper the used ribbon 420 having a width W of about 5.7 cm (about 2.25 in) and a thickness of about 0.00254 cm (about 0.001 in) into the used ribbon strand 465 having a width of about 0.1905 cm (about 0.075 in) and a thickness of about 0.0254 cm (about 0.010 in). In other embodiments, the size of the aperture 440 where the used ribbon strand 465 exits the aperture 440 can be adjusted for different sized used ribbons or to fit the needs of the user.

After the used ribbon 420 is tapered, twisted and pinched by the tapering mechanism 425 to form the used ribbon strand 465, the used ribbon strand 465 is then fed through the heating mechanism 430. The heating mechanism 430 includes a level controller 427 and a roller 433 that fuse the used ribbon strand 465 into a used ribbon string 470. By fusing the used ribbon strand 465 to form the ribbon string 470, the ribbon cannot be unrolled, thereby preventing access to any information that may have been imparted onto the used ribbon 420, effectively destroying the used ribbon 420.

The level controller 427 includes a base 472 that holds vertical support poles 476, and a level portion 474 with a level aperture 475 and holes 478. The level aperture 475 allows the used ribbon strand 465 to pass there through. The holes 478 allow the support poles 476 to pass there through.

The level controller 427 is designed to evenly wind (i.e. level wind) the used ribbon strand 465 up and down the roller 433 similar to how fishing line is wound up and down the fishing spool of a fishing reel. In particular, the level controller 427 is designed to allow the level aperture 475 to change its vertical position by sliding the level portion 474 along the vertical support poles 476. In one embodiment, the vertical position of the level portion 474 is manually adjusted by the user. In another embodiment, the vertical position of the level portion 474 is automatically adjusted by the used ribbon destruction device 400. By varying the vertical position of the level portion 474, and thereby the vertical position of the level aperture 475, the used ribbon destruction device 400 can control the location where the used ribbon strand 470 is wound along the roller 433 of the heating mechanism 430.

As shown in FIG. 4, after the used ribbon strand 465 is fed through the level controller 427, the used ribbon strand 465 is then fed to the roller 433. In one embodiment, the used ribbon strand 465 makes at least one complete revolution around the roller 433. In some embodiments, the roller 433 of the roller mechanism 430 is a hard roller, in which at least the outer layer of the roller 433 is made of a steel material. In other embodiments, the roller 433 is a compliant roller, in which at least the outer layer of the roller 433 is made of a rubber back material. Also, in some embodiments, the roller 433 can be driven by a backup roller (not shown) in order to help pull the used ribbon 420 past the print mechanism 415, through the tapering mechanism 425 and into the heating mechanism 430 to feed the used ribbon strand 465 around the roller 433.

In the embodiment described herein, the roller 433 is a heated roller to fuse the used ribbon strand 465 as the used ribbon strand 465 passes through the heating mechanism 430. The roller 433 heats the material of the used ribbon strand 465 sufficiently to cause the used ribbon strand 465 to begin to fuse into a used ribbon string 470. The temperature of the roller 433 can vary depending on the type of ribbon used. For example, in the embodiment described herein, the roller 433 is heated to a temperature such that the used ribbon strand 465 is heated to a temperature between 150 to 200 degrees Celsius. However, based on the needs of the user, the temperature of the roller 433 is configurable and can be adjusted by the user.

After the used ribbon strand 465 is wound around the roller 433 of the heating mechanism 430, the resulting used ribbon string 470 is fed into the disposing mechanism 435. The disposing mechanism 435 includes cutting rollers 482 and a removable bin 484. The used ribbon string 470 is fed between the cutting rollers 482, where the used ribbon string 470 is cut into pieces and then dropped into the removable bin 474. The chop rate of the cutting rollers 482 can be modified by the user to cut the used ribbon string 470 into larger or smaller pieces. Also, the chop pattern of the cutting rollers 482 can be altered by the user between, for example, a bias cut or a cross cut to further prevent an unauthorized party from accessing the information transferred onto the used ribbon 420. The removable bin 474 can then be removed by the user to dispose of the cut pieces of the used ribbon string 470.

In some embodiments, the cutting rollers 482 and the removable bin 484 are replaced with a disposable take-up spool (similar to the disposable take-up spool 380 in FIG. 3) that winds the used ribbon string 470. Once a sufficient amount of the used ribbon string, as determined by the user, is wound around the disposable take-up spool, the user can simply remove and dispose of the take-up spool and place a new disposable take-up spool in the disposing mechanism 435.

Figure 5:
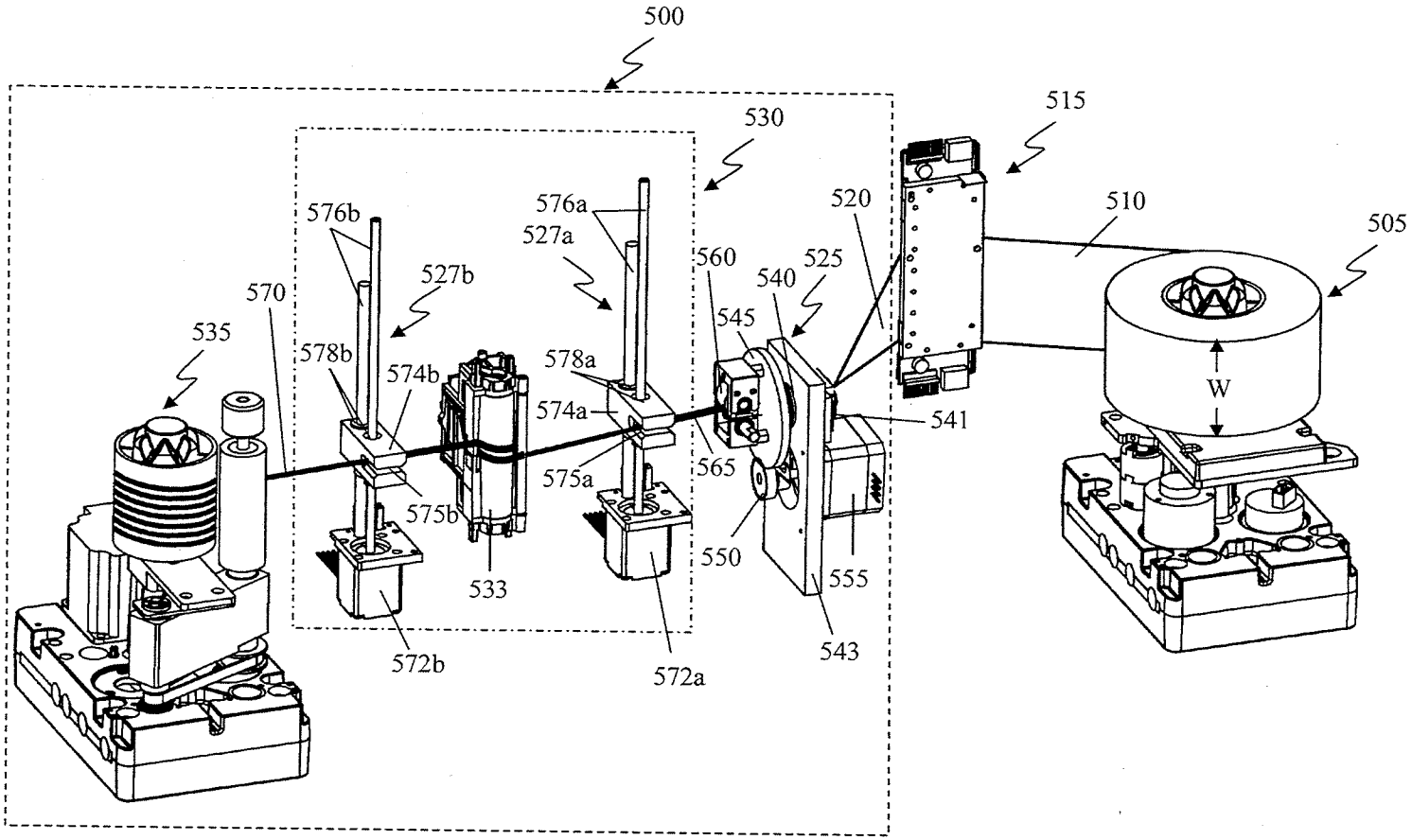
FIG. 5 illustrates a perspective view of a third embodiment of a used ribbon destruction device incorporated within the modular central issuance personalization machine of FIG. 2.

FIG. 5 schematically depicts a third embodiment of a used ribbon destruction device 500 mounted within the modular central issuance personalization machine 200 of FIG. 2. A print ribbon supply spool 505 supplies print ribbon 510 to a print mechanism 515, for example a thermal print head. After printing or otherwise passing by the print mechanism 515, the print ribbon is considered to be used ribbon 520. The used ribbon 520 is then directed to the used ribbon destruction device 500 for destroying the ribbon.

In the illustrated example, the used ribbon destruction device 500 includes a tapering mechanism 525, a heating mechanism 530 and a disposing mechanism 535.

The tapering mechanism 525 includes an aperture 540, a rotating disk 545, and a pincher 560. The tapering mechanism 525 is configured to taper the used ribbon 520 into a used ribbon strand 565.

The aperture 540 is an opening formed through an entry plate 541, a support plate 543 and the rotating disk 545. The aperture 540 can be any type of opening that works in conjunction with the pincher 560 to taper the used ribbon 520 into the used ribbon strand 565. For example, the aperture 540 can be a hole, a slot, or other type of passageway or geometry through which the used ribbon 520 passes to cause the used ribbon 520 to become tapered. The aperture 540 can be tapered so that its dimension at the entry plate 541 is greater than its dimension at the rotating disk 545.

In the embodiment shown in FIG. 5, the used ribbon 520 is also twisted by the rotating disk 545 while passing through the aperture 540. This twisting is performed to ensure that the resulting used ribbon strand 565 does not increase substantially in width or thickness after passing through the pincher 560. In the embodiment shown in FIG. 5, the twisting is caused by rotating the rotating disk 545 while the used ribbon 520 is fed through the aperture 540. The rotating disk 545 is driven by a driver (i.e. spinner) disk 550 attached to a motor 555.

After the used ribbon 520 is tapered and twisted by passing through the aperture 540 of the rotating disk 545, the tapered and twisted used ribbon 520 is passed through the pincher 560 that pinches the tapered and twisted used ribbon 520 into the used ribbon strand 565.

The size of the aperture 540 where the used ribbon strand 565 exits the aperture 540, the strength of the pincher 560, and the width and thickness of the used ribbon 520 all factor into the resulting width and thickness of the resulting used ribbon strand 565. The size of the aperture 540 where the used ribbon strand 565 exits the aperture 540 is sufficiently small to taper the used ribbon 520 passing through the aperture 540. In the embodiment described herein, the size of the aperture 540 where the used ribbon strand 565 exits the aperture 540 is between 0.1 to 0.15 inches in diameter. For example, in the embodiment shown in FIG. 5, the aperture 540 where the used ribbon strand 565 exits the aperture 540 is sized and the pincher 560 is configured to taper the used ribbon 520 having a width W of about 5.7 cm (about 2.25 in) and a thickness of about 0.00254 cm (about 0.001 in) into the used ribbon strand 565 having a width of about 0.1905 cm (about 0.075 in) and a thickness of about 0.0254 cm (about 0.010 in). In other embodiments, the size of the aperture 540 where the used ribbon strand 565 exits the aperture 540 can be adjusted for different sized used ribbons or to fit the needs of the user.

After the used ribbon 520 is tapered, twisted and pinched by the tapering mechanism 525 to form the used ribbon strand 565, the used ribbon strand 565 is then fed to the heating mechanism 530. The heating mechanism 530 includes first level controller 527*a*, second level controller 527*b* and a roller 533 to fuse the used ribbon strand 565 into a used ribbon string 570. By fusing the used ribbon strand 565 to form the ribbon string 570, the ribbon cannot be unrolled, thereby preventing access to any information that may have been imparted onto the used ribbon 520, effectively destroying the used ribbon 520.

The first level controller 527*a* includes a base 572*a* that holds vertical support poles 576*a*, and a level portion 574*a* with a level aperture 575*a* and holes 578*a*. The level aperture 575*a* allows the used ribbon strand 565 to pass there through. The holes 578 allow the support poles 576*a* to pass there through.

The first level controller 527*a* is designed to evenly wind (i.e. level wind) the used ribbon strand 565 up and down the roller 533 similar to how fishing line is wound up and down the fishing spool of a fishing reel. In particular, the first level controller 527*a* is designed to allow the level aperture 575*a* to change its vertical position by sliding the level portion 574*a* up and down along the vertical support poles 576*a*. In one embodiment, the vertical position of the level portion 574*a* is manually adjusted by the user. In another embodiment, the vertical position of the level portion 574*a* is automatically adjusted by the used ribbon destruction device 500. By varying the vertical position of the level portion 574*a*, and thereby the vertical position of the level aperture 575*a*, the used ribbon destruction device 500 can control the location where the used ribbon strand 565 is wound along the roller 533.

As shown in FIG. 5, after the used ribbon strand 565 is fed through the first level controller 527*a*, the used ribbon strand 565 is then fed to the roller 533. In one embodiment, the used ribbon strand 565 makes at least one complete revolution around the roller 533. In some embodiments, the roller 533 is a hard roller, in which at least the outer layer of the roller 533 is made of a steel material. In other embodiments, the roller 533 is a compliant roller, in which at least the outer layer of the roller 533 is made of a rubber back material. Also, in some embodiments, the roller 533 can be driven by a motor to rotate in order to help pull the used ribbon 520 past the print mechanism 515, through the tapering mechanism 525 and through the first level controller 527*a* to feed the used ribbon strand 565 around the roller 533.

In the embodiment described herein, the roller 533 is a heated roller to fuse the used ribbon strand 565 as the used ribbon strand 565 passes through the heating mechanism 530. The roller 533 heats the material of the used ribbon strand 565 sufficiently to cause the used ribbon strand 565 to begin to fuse into a used ribbon string 570. The temperature of the roller 533 can vary depending on the type of ribbon used. For example, in the embodiment described herein, the roller 533 is heated to a temperature such that the used ribbon strand 565 is heated to a temperature between 150 to 200 degrees Celsius. However, based on the needs of the user, the temperature of the roller 533 is configurable and can be adjusted by the user.

After the used ribbon strand 565 is fed to wound around the roller 533 of the heating mechanism 530, the resulting used ribbon string 570 is then fed to the second level controller 527*b*. Similar to the first level controller 527*a*, the second level controller 527*b* includes a base 572*b* that holds vertical support poles 576*b*, and a level portion 574*b* with a level aperture 575*b* and holes 578*b*. The level aperture 575*b* allows the used ribbon string 570 to pass there through. The holes 578*b* allow the support poles 576*b* to pass there through.

The second level controller 527*b* is designed to evenly wind (i.e. level wind) the used ribbon string 570 up and down the disposable take-up spool 580 similar to how fishing line is wound up and down the fishing spool of a fishing reel. In particular, the level controller 527*b* is designed to allow the level aperture 575*b* to change its vertical position by sliding the level portion 574*b* along the vertical support poles 576*b*. In one embodiment, the vertical position of the level portion 574*b* is manually adjusted by the user. In another embodiment, the vertical position of the level portion 574*b* is automatically adjusted by the used ribbon destruction device 500. By varying the vertical position of the level portion 574*b*, and thereby the vertical position of the level aperture 575*b*, the used ribbon destruction device 500 can control the location where the used ribbon string 570 is wound along a disposable take-up spool 580 of the disposing mechanism 535. This allows the used ribbon string 570 to be evenly distributed up and down the disposable take-up spool 580.

As shown in FIG. 5, after the used ribbon string 570 is fed through the second level controller 574*b*, the used ribbon string 570 is then fed to the disposing mechanism 535, where the used ribbon string 570 is wound around the disposable take-up spool 580. In one embodiment, the disposable take-up spool 580 is rotatably driven by a motor in order to pull the ribbon from the supply spool 505, past the print mechanism 515, through the tapering mechanism 525, through the heating mechanism 535 and onto the disposable take-up spool 580. Once a sufficient amount, as determined by the user, of the used ribbon 520 is formed into the used ribbon string 570 and wound around the disposable take-up spool 580, the disposable take-up spool 580 can be simply removed and disposed of. The user can then place a new take-up spool into the disposing mechanism 535.

In some embodiments, the take-up spool 580 is replaced with cutting rollers (similar to the cutting rollers 482 in FIG. 4) to cut the used ribbon string 570 into a plurality of pieces, and a removable bin (similar to the removable bin 484 in FIG. 4) that allows the user to remove and dispose of the pieces of the used ribbon string 570.

The invention may be embodied in other forms without departing from the spirit or novel characteristics thereof The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

The invention claimed is:

1. A method for securely destroying used ribbon from a card or passport personalization machine by a ribbon destruction device incorporated in the card or passport personalization machine, the method comprising:

after the ribbon has been used in the card or passport personalization machine and while the used ribbon remains in the card or passport personalization machine, tapering the used ribbon into a used ribbon strand by passing the used ribbon through an aperture of a tapering mechanism of the ribbon destruction device incorporated in the card or passport personalization machine;

heating the used ribbon strand to fuse the used ribbon strand into a used ribbon string by feeding the used ribbon through a heating mechanism of the ribbon destruction device incorporated in the card or passport personalization machine.

2. The method of claim 1, further comprising feeding the used ribbon string to a disposing mechanism of the ribbon destruction device.

3. The method of claim 1, wherein heating the used ribbon strand comprises winding the used ribbon strand at least one complete revolution around a heated roller of the heating mechanism.

4. The method of claim 2, further comprising winding the used ribbon string onto a disposable take-up spool of the disposing mechanism, and removing the disposable take-up spool from the card or passport personalization machine and disposing of the disposable take-up spool with wound used ribbon string.

5. The method of claim 2, further comprising using the disposing mechanism to cut the used ribbon string into a plurality of pieces with the cut pieces of the used ribbon string dropping into a removable bin that is removably disposed in the card or passport personalization machine.

6. The method of claim 1, wherein the card or passport personalization machine comprises a central issuance personalization machine.

7. The method of claim 1, wherein the card or passport personalization machine comprises a desktop personalization machine.

8. The method of claim 1, wherein the used ribbon is one of the following types of ribbon-like material: indent ribbon; indent printing foil; retransfer ribbon; retransfer material; topping foil; monochromatic ribbon; Cyan Magenta Yellow black (CMYK) plus spot color thermal transfer ribbon; CMYK plus spot color thermal retransfer ribbon; and primer ribbon.

9. The method of claim 1, wherein the aperture has a diameter at a location where the used ribbon strand exits the aperture between 0.1 to 0.15 inches.

10. The method of claim 1, wherein the used ribbon strand is heated to a temperature between 150 to 200 degrees Celsius to fuse the used ribbon strand into the used ribbon string.

11. A device for securely destroying used ribbon from a card or passport personalization machine, wherein the device is incorporated in the card or passport personalization machine and destroys the used ribbon after the ribbon has been used in the card or passport personalization machine and while the used ribbon remains in the card or passport personalization machine, the device comprising:

a tapering mechanism that includes an aperture that is positioned to receive the used ribbon therethrough and taper the used ribbon into a used ribbon strand as the used ribbon is passed through the aperture;

a heating mechanism downstream from the tapering mechanism that heats the used ribbon strand which fuses the used ribbon strand into a used ribbon string.

12. The device of claim 11, further comprising a disposing mechanism downstream from the heating mechanism for disposing the used ribbon string.

13. The device of claim 11, wherein the heating mechanism comprises a heated roller that heats the used ribbon strand in order to fuse the used ribbon strand into the used ribbon string.

14. The device of claim 12, wherein the disposing mechanism comprises a disposable take-up spool that winds the used ribbon string for removing and disposing of the used ribbon string, the disposable take-up spool is removably mounted in the card or passport personalization machine.

15. The device of claim 12, wherein the disposing mechanism comprises:

cutting rollers that cut the used ribbon string into a plurality of pieces; and a removable bin that is removably disposed in the card or passport personalization machine adjacent to the cutting rollers for collecting the pieces of the used ribbon string.

16. A central issuance card or passport personalization machine comprising the device of claim 11.

17. A desktop card or passport personalization machine comprising the device of claim 11.

18. The device of claim 11, wherein the used ribbon is one of the following types of ribbon-like material: indent ribbon; indent printing foil; retransfer ribbon; retransfer material; topping foil; monochromatic ribbon; Cyan Magenta Yellow black (CMYK) plus spot color thermal transfer ribbon; CMYK plus spot color thermal retransfer ribbon; and primer ribbon.

19. The device of claim 11, wherein the aperture has a diameter at a location where the used ribbon strand exits the aperture between 0.1 to 0.15 inches.

20. The device of claim 11, wherein the used ribbon strand is heated to a temperature between 150 to 200 degrees Celsius to fuse the used ribbon strand into the used ribbon string.

* * * * *